US010709186B2

(12) United States Patent
Blackford et al.

(10) Patent No.: US 10,709,186 B2
(45) Date of Patent: Jul. 14, 2020

(54) MULTISPECTRAL COOLING FABRIC

(71) Applicant: Columbia Sportswear North America, Inc., Portland, OR (US)

(72) Inventors: Michael E. "Woody" Blackford, Portland, OR (US); Jeffrey Thomas Mergy, Portland, OR (US); Haskell Beckham, Portland, OR (US)

(73) Assignee: Columbia Sportswear North America, Inc., Portland, OR (US)

( * ) Notice: Subject to any disclaimer, the term of this patent is extended or adjusted under 35 U.S.C. 154(b) by 0 days.

(21) Appl. No.: 16/227,311

(22) Filed: Dec. 20, 2018

(65) Prior Publication Data

US 2019/0116902 A1 Apr. 25, 2019

Related U.S. Application Data

(63) Continuation-in-part of application No. 15/866,267, filed on Jan. 9, 2018.

(60) Provisional application No. 62/444,259, filed on Jan. 9, 2017.

(51) Int. Cl.
*A41D 31/04* (2019.01)
*A41D 13/005* (2006.01)

(52) U.S. Cl.
CPC ..... *A41D 31/04* (2019.02); *A41D 13/0053* (2013.01); *A41D 2400/26* (2013.01)

(58) Field of Classification Search
CPC ..... A41D 31/04; A41D 13/0053; A41D 2400/00; A41D 19/01541; A41D 20/005; A41D 2023/002
USPC ..... 2/49, 243.1, 456; 428/640; 442/131, 132
See application file for complete search history.

(56) References Cited

U.S. PATENT DOCUMENTS

| | | | | |
|---|---|---|---|---|
| 6,686,042 | B1 * | 2/2004 | LeGallee | B32B 7/02 106/404 |
| 2013/0042390 | A1 * | 2/2013 | Blackford | A43B 1/00 2/243.1 |
| 2013/0133353 | A1 * | 5/2013 | Araujo | F25D 31/00 62/331 |
| 2017/0226347 | A1 * | 8/2017 | Jin | D06M 11/38 |

FOREIGN PATENT DOCUMENTS

| | | | |
|---|---|---|---|
| CH | 703450 | A1 | 1/2012 |
| WO | 2015/188190 | A1 | 12/2015 |

* cited by examiner

*Primary Examiner* — Matthew D Matzek
(74) *Attorney, Agent, or Firm* — Schwabe, Williamson & Wyatt, P.C.

(57) ABSTRACT

Embodiments of the present disclosure relate generally to a base fabric for body gear and other goods having designed performance characteristics, and in particular to technical gear, such as garments, that utilize multispectral cooling elements coupled to the exterior facing surface of a base fabric.

19 Claims, 15 Drawing Sheets

MULTISPECTRAL COOLING FABRIC

CROSS-REFERENCE TO RELATED APPLICATION

This application is a Continuation in Part of U.S. patent application Ser. No. 15/866,267, filed Jan. 9, 2018, which claims the priority benefit of the earlier filing date of U.S. Provisional Application No. 62/444,259, filed Jan. 9, 2017, both of which are hereby incorporated herein by reference in their entirety

TECHNICAL FIELD

Embodiments of the present disclosure relate generally to a base fabric for body gear and other goods having designed performance characteristics, and in particular to technical gear, such as garments, that utilize one or more elements that reflect solar light, limit solar energy transmission, and emit thermal radiation at wavelengths comparable to that of the human body, coupled to the exterior facing surface of the base fabric.

BACKGROUND

Performance fabric materials such as wicking materials and cooling materials typically take the form of uniform layers that are woven into or otherwise incorporated into a garment. Cooling fabrics that incorporate a layer of cooling materials such as highly absorbent polymers have shortcomings, particularly when incorporated into the base fabric as a continuous layer. For example, a uniform layer of polymeric material may impede the transfer of moisture vapor or restrict air passage through the base fabric. Furthermore, such cooling materials may impede a desired characteristic of the base fabric, such as drape, texture, stretch, and the like. Thus, the use of a layer of cooling material may impede the breathability (or another function) of the underlying base fabric.

BRIEF DESCRIPTION OF THE DRAWINGS

Embodiments of the present disclosure will be readily understood by the following detailed description in conjunction with the accompanying drawings. Embodiments of the invention are illustrated by way of example and not by way of limitation in the figures of the accompanying drawings.

DETAILED DESCRIPTION OF EMBODIMENTS

Figure 1A:
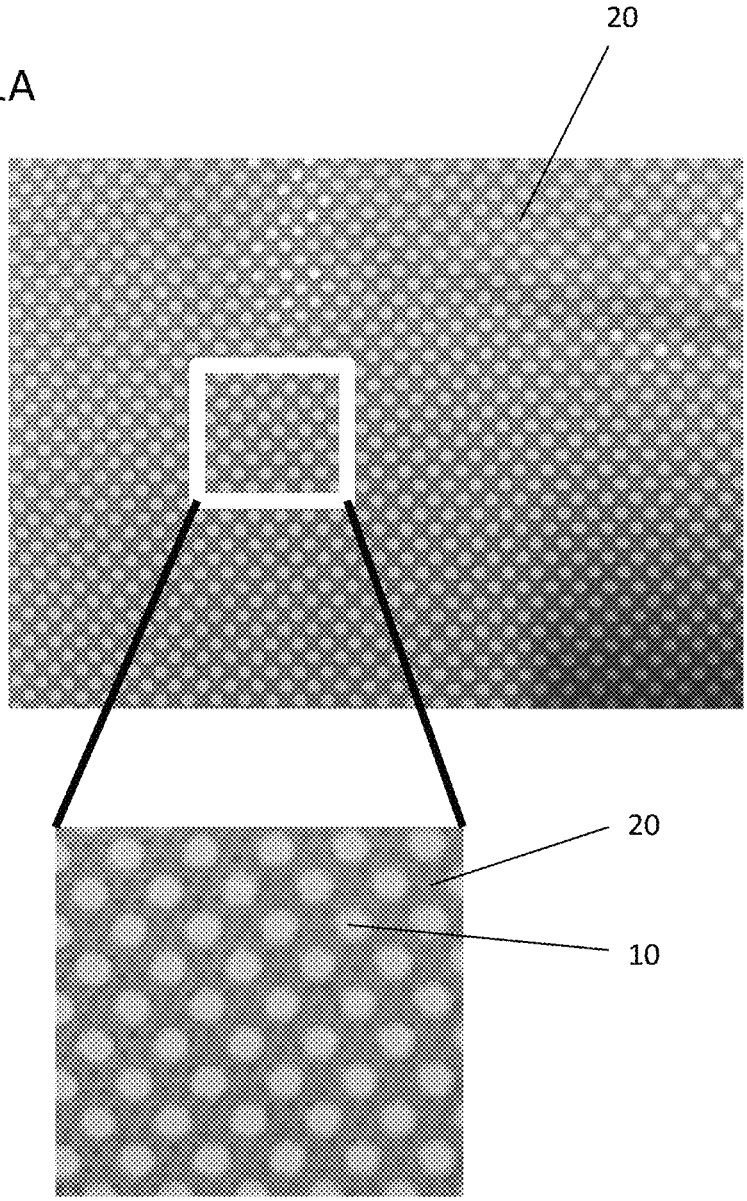
FIG. 1A illustrates an example of a discontinuous pattern of multispectral cooling elements disposed on the exterior facing surface of a base fabric, in accordance with various embodiments.

In the following detailed description, reference is made to the accompanying drawings which form a part hereof, and in which are shown by way of illustration embodiments in which the disclosure may be practiced. It is to be understood that other embodiments may be utilized and structural or logical changes may be made without departing from the scope of the present disclosure. Therefore, the following detailed description is not to be taken in a limiting sense, and the scopes of embodiments, in accordance with the present disclosure, are defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact, and may be directly and or individually coupled.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

One of the problems with technical gear is that when exposed to the rays of the sun for a prolonged period, the technical gear tends to absorb the radiation from these rays, which results in heat being transmitted to the wearer. In addition, some materials are designed to hold heat in and/or reflect the heat back to the wearer. An example of such materials are the Omni-Heat suite of products sold by Columbia Sportswear. While such products are desirable in cold weather applications, technical gear that provides cooling to and/or heat emission from the wearer are equally desirable in warm weather conditions. To meet these needs, the inventors have developed materials that provide cooling to, and/or heat emission from, the wearer, for example by reflecting sunlight, limiting sunlight transmission (such as through the fabric), and emitting spectral energy in the wavelengths comparable to that emitted by the skin of a wearer.

To meet the needs discussed above, the inventors have developed a material (also referred to herein as solar deflector) in which a pattern of multispectral cooling elements have been coupled to the outward facing surface of a base fabric, wherein the multispectral cooling elements reflect solar light, limit solar energy transmission, and emit thermal radiation at wavelengths comparable to that of the human body (see for example FIGS. 8, 9, and 11), for example relative to base fabric. Thus, disclosed herein is a multispectral cooling material adapted for use with bodywear. In some embodiments, a base fabric, for example as adapted for body gear, is disclosed that may use a pattern of multispectral cooling elements coupled to the outward facing surface of the base fabric, wherein the multispectral cooling elements reflect solar light in the UV, visible and near IR spectrum, for example as compared to the base fabric.

The disclosed multispectral cooling material includes a base fabric having an externally facing surface, and in some embodiments, having one or more performance characteristics. Coupled to the externally facing surface of the base fabric are one or more multispectral cooling elements, wherein the placement and spacing of the one or more multispectral cooling elements leaves a portion of the base fabric uncovered and enables the base material to retain at least partial performance of the performance characteristic. These multispectral cooling elements have been specifically developed by the inventors to provide reflection, transmission, and emission characteristics that aid in cooling a wearer (see for example FIGS. 4A and 4B). In embodiments, the disclosed multispectral cooling elements comprise metal oxide particles, such as rutile titanium dioxide ($TiO_2$), with characteristic average sizes less than 0.4 μm or less than 0.25 μm, and a polymeric binder.

Figure 6:
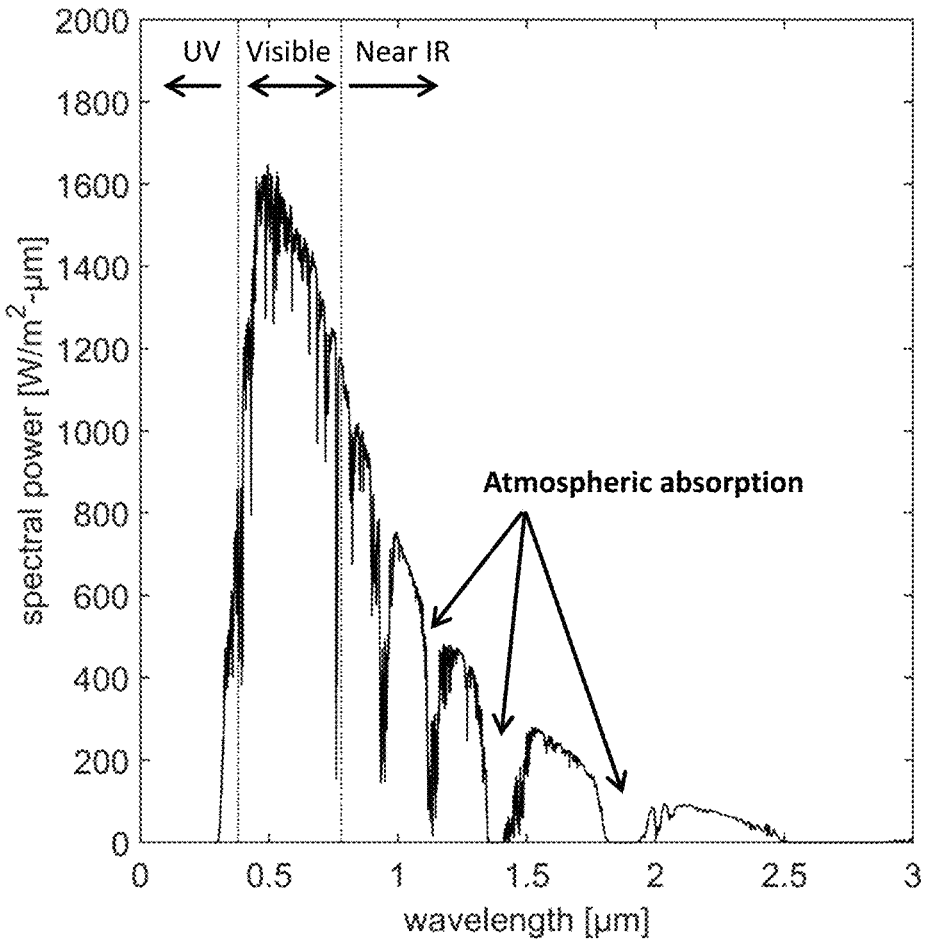
FIG. 6 is a graph from ASTM G173, the solar spectrum at the earth's surface.

In embodiments, the multispectral cooling material reflects greater than 5% more of the total solar energy in the wavelengths that reach the surface of the earth (see FIG. 6) as compared to the base fabric, such as greater than 5%, greater than 6%, greater than 7%, greater than 8%, greater than 9%, greater than 10%, greater than 11%, greater than 12%, greater than 13%, greater than 14%, greater than 15%, greater than 16%, greater than 17%, greater than 18%, greater than 19%, greater than 20%, greater than 21%, greater than 22%, greater than 23%, greater than 24%, greater than 25%, greater than 26%, greater than 27%, greater than 28%, greater than 29%, greater than 30%, greater than 31%, greater than 33%, greater than 34%, or even greater than 35% more of the total solar energy in the wavelengths that reach the surface of the earth (see FIG. 6) as compared to the base fabric (see Table 1). In embodiments, the multispectral cooling material reflects greater than 5% more of the total solar energy in the wavelengths that reach the surface of the earth as compared to the base fabric, such as greater than 5%, greater than 6%, greater than 7%, greater than 8%, greater than 9%, greater than 10%, greater than 11%, greater than 12%, greater than 13%, greater than 14%, greater than 15%, greater than 16%, greater than 17%, greater than 18%, greater than 19%, greater than 20%, greater than 21%, greater than 22%, greater than 23%, greater than 24%, greater than 25%, greater than 26%, greater than 27%, greater than 28%, greater than 29%, greater than 30%, greater than 31%, greater than 33%, or greater than 34% more of the solar energy in the 0.25 μm to 2.5 μm wavelength range as compared to the base fabric (see Table 1). What was even more surprising was that when only the UV/Vis spectral region was considered, the disclosed multispectral cooling material reflects greater than 50% more of the UV/Vis solar energy as compared to the base fabric, for example between about 0.25 μm to 0.78 μm in wavelength relative to the base fabric (see Table 1). In embodiments, the multispectral cooling material reflects greater than 50% more of the UV/Vis solar energy as compared to the base fabric, for example between about the 0.25 μm to 0.78 μm, such as greater than 55%, greater than 60%, greater than 65%, greater than 70%, greater than 75%, greater than 80%, greater than 85%, greater than 90%, greater than 95%, greater than 100%, greater than 125%, greater than 150%, greater than 175%, greater than 200%, greater than 225%, greater than 250%, or even greater than 263% more of the UV/Vis solar energy between about 0.25 μm to 0.78 μm in wavelength relative to the base fabric.

In addition to increasing the amount of reflected solar energy, the multispectral cooling material reduces the amount of solar energy transmitted as compared to the base material. For the embodiment shown in FIG. 9 the data indicate the multispectral cooling material transmits approximately 14% less solar energy than the base material. However, one of ordinary skill in the art can readily see that the reduction in percentage transmission could be further increased by (a) increasing the surface coverage of multispectral cooling elements, (b) applying the multispectral cooling elements onto a thinner base fabric, or (c) utilizing thicker or more efficient multispectral cooling elements that provide an additional amount of transmission reduction. The multispectral cooling elements may be made more efficient by altering particle size, chemistry, or concentration in the polymeric binder, for example.

Figure 10:
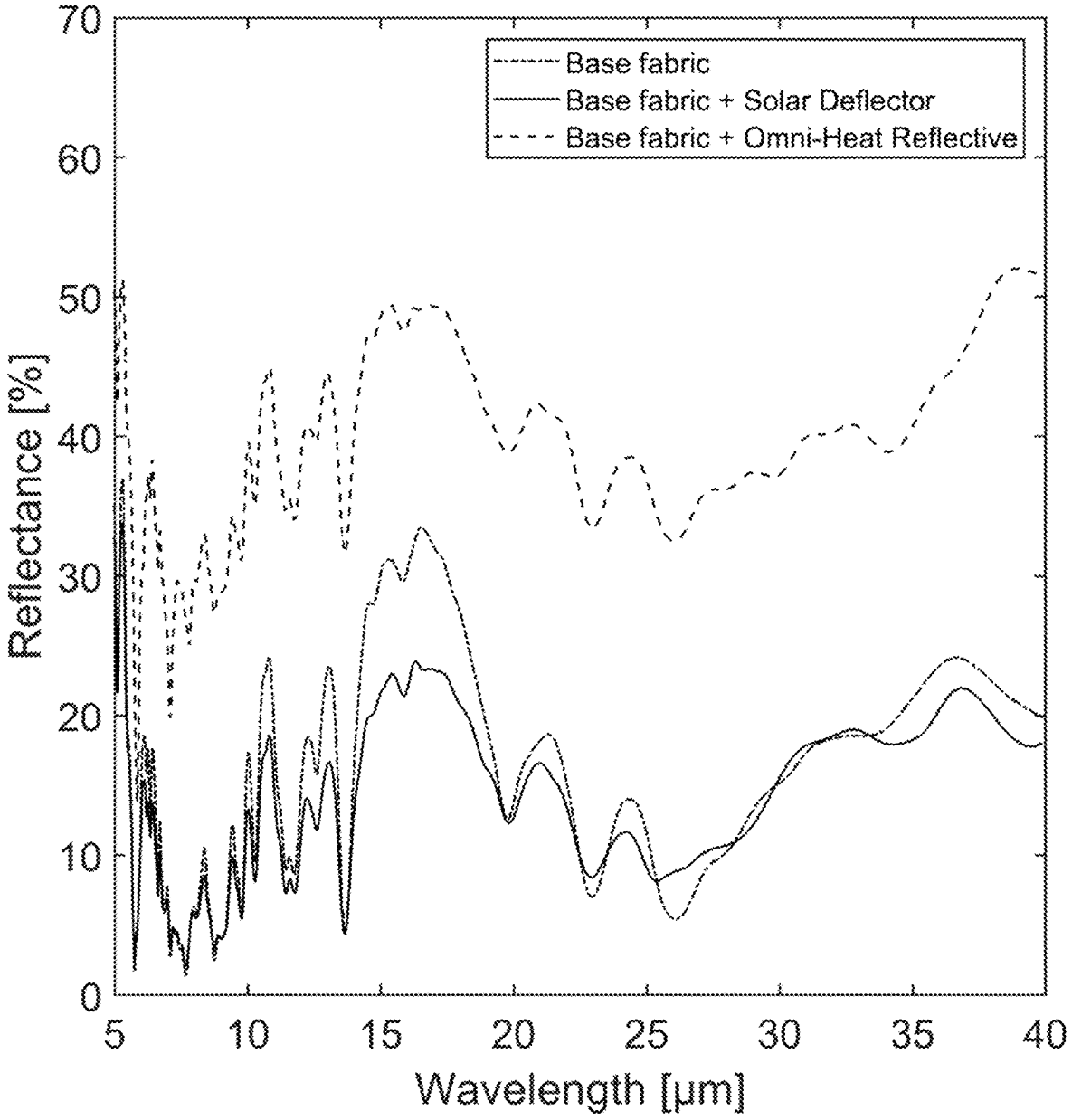
FIG. 10 is a graph of spectroscopic reflectance measurements from $5<\lambda<40$ μm for solar deflector (SD), Omni-Heat and base fabric.
Figure 11:
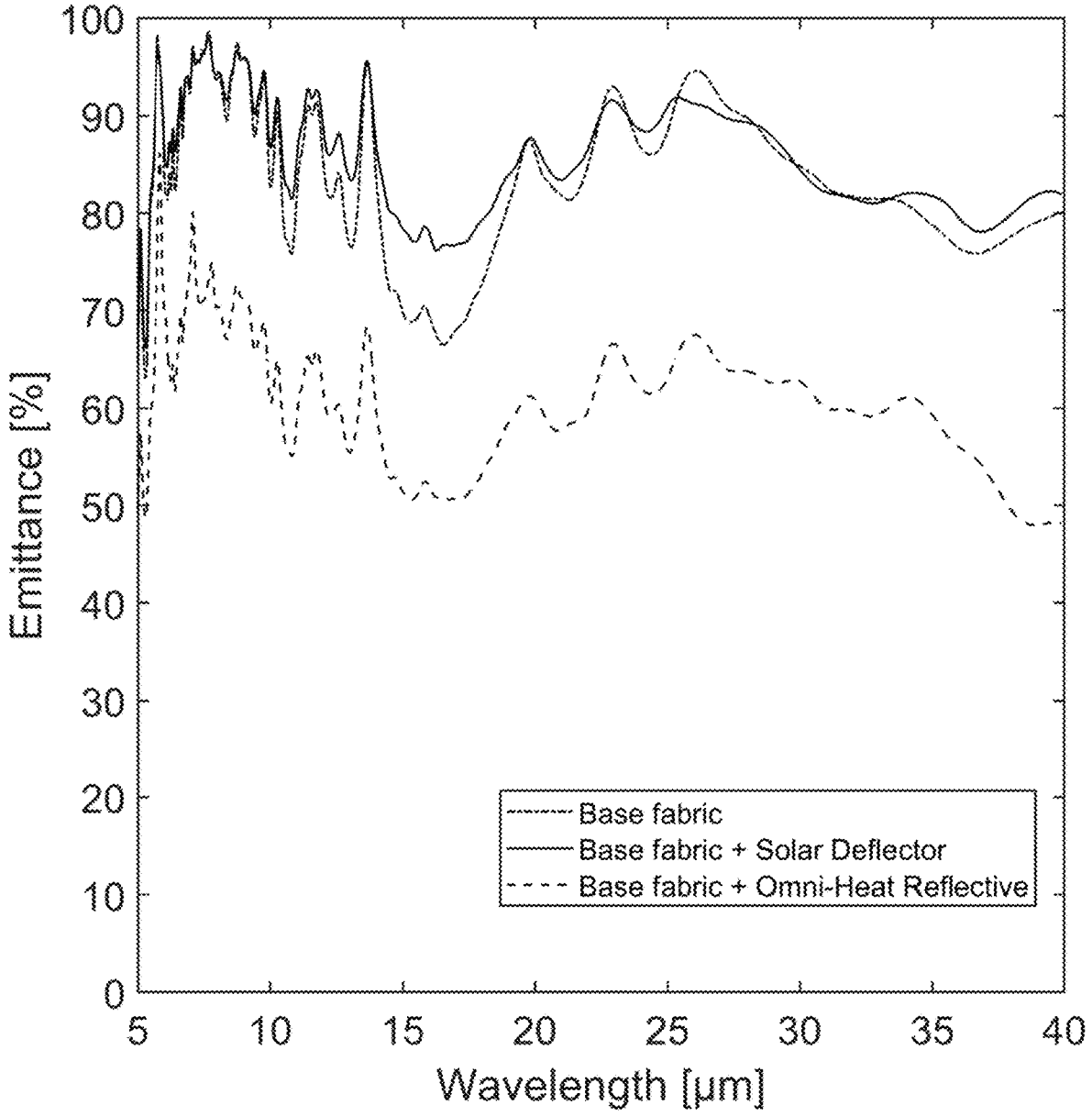
FIG. 11 is a graph of spectroscopic emittance measurements from $5<\lambda<40$ μm for solar deflector (SD), Omni-Heat and base fabric.

In addition to the reflectivity in the solar spectrum, the disclosed multispectral cooling material imparts cooling to a wearer by increasing (relative to base fabric) the emission in the wavelength range given off or emitted by the skin of the wearer (see FIGS. 10 and 11). In embodiments, the multispectral cooling material increased emission more than 1% in the 5 μm to 40 μm wavelength range compared to the base fabric alone (see Table 1), such as greater than 1.5%, greater than 2.0%, greater than 2.5%, or even greater than 3.0% in energy emission in the 5 μm to 40 μm wavelength range compared to the base fabric alone.

The disclosed multispectral cooling elements can be coupled to base fabrics of any color, which may influence the differences in the percent reflectance in the total solar spectrum and the UV/visible spectrum relative to the base fabric alone. The color of the base fabric may have an effect on the transmission, and emission characteristics of the multispectral cooling material. Thus, some variation in solar energy reflectance in the 0.25 μm to 2.5 μm wavelength range compared to the base fabric alone, solar energy reflectance in the 0.25 μm to 0.78 μm wavelength range compared to the base fabric alone, reduction in transmission in the 0.25 μm to 2.5 μm wavelength range compared to the base fabric alone, and energy emission in the 5 μm to 40 μm wavelength range compared to the base fabric alone would be expected depending on the color of the base fabric. For example, while not being bound by theory, it is expected that the difference in percent reflection in both the UV/Vis and total solar spectrum would be greater for black base fabric than white base fabric when comparing the base fabric alone versus base fabric comprising multispectral cooling elements. The spectral characteristics, and the consequent differences in reflection, transmission and emission between a base fabric and the same base fabric comprising multispectral cooling elements, may depend also on the surface coverage, thickness, physical characteristics and chemical constitution of the multispectral cooling elements.

In embodiments, the multispectral cooling elements 10 are a discontinuous array of a foil, such as a white pigmented foil. In embodiments, the foil includes a reflective metal oxide and/or a metalloid oxide. In particular embodiments the multispectral cooling elements include one or more of aluminum oxide ($Al_2O_3$), boron oxide ($B_2O_3$), bismuth oxide ($Bi_2O_3$), cerium dioxide ($CeO_2$), magnesium oxide (MgO), silicon dioxide ($SiO_2$), tin oxide (SnO and $SnO_2$), titanium dioxide ($TiO_2$), zinc oxide (ZnO), and zirconium dioxide ($ZrO_2$). Additional useful energy deflecting agents which may be added to vary the performance and/or appearance of the energy deflecting agents include chromium oxide (CrO, $CrO_2$, $CrO_3$, $Cr2O_3$, and mixed valence species such as $Cr_8O_{21}$), iron oxide (FeO, $Fe_2O_3$, and mixed valence species such as $Fe_3O_4$), and manganese oxide (MnO, $MnO_2$, and mixed valence species such as $Mn_3O_4$), which may be used alone, in combination, or even in combination with the oxides listed above.

Solid solutions of oxides may also be used alone or in combination with other oxides such as those listed above. In another embodiment, pigments may be added to the oxide, solid solutions of oxides, or mixtures of oxides to vary the performance and/or appearance of the deflecting agent, such as the solid oxide solutions disclosed in U.S. Pat. No. 6,454,848, which is hereby incorporated herein by reference in its entirety.

In specific embodiments, a multispectral cooling element includes, consists of, or consists essentially of $TiO_2$ and/or ZnO. In specific embodiments, a multispectral cooling element may include between about 20% and 100% $TiO_2$ by weight, with the remainder being made up of one or more of the materials above, such as 80 weight (wt) % $TiO_2$, 60 wt % $TiO_2$, 50 wt % $TiO_2$, 40 wt % $TiO_2$, or 20 wt % $TiO_2$. In specific embodiments, a multispectral cooling element may include between about 20% and 100% ZnO by weight, with the remainder being made up of one or more of the materials above, such as 80 weight (wt) % ZnO, 60 wt % ZnO, 50 wt % ZnO, 40 wt % ZnO, or 20 wt % ZnO. The weight (wt) % above can be applied to the other material described above.

Figure 4A:
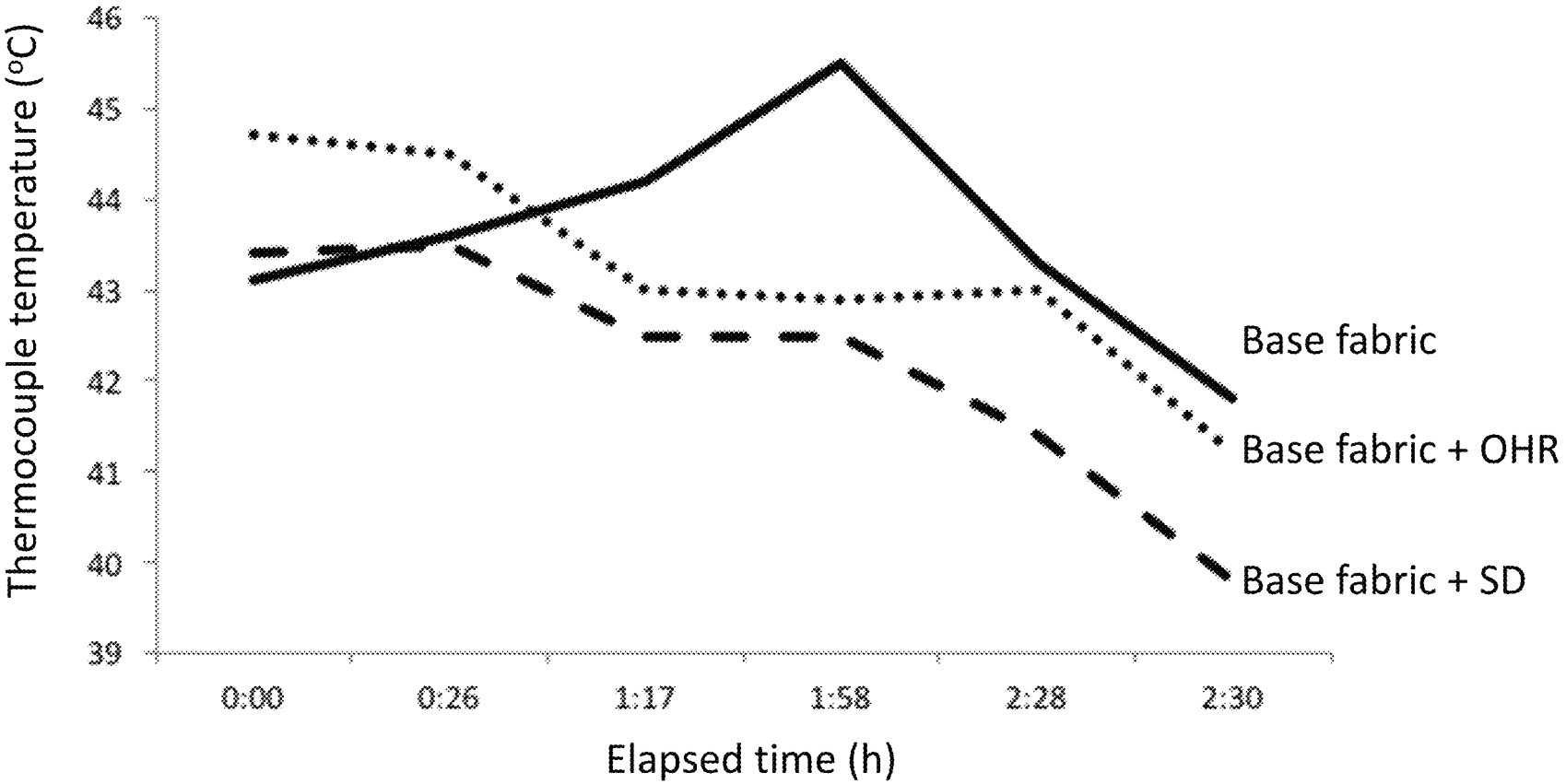
FIGS. 4A and 4B are graphs illustrating temperature vs. time comparisons for various fabrics exposed to sunlight, including examples of a discontinuous pattern of multispectral cooling elements disposed on the exterior facing surface of a base fabric, in accordance with various embodiments. Data are shown for a base fabric and the same base fabric with multispectral cooling elements (solar deflector fabric (SD)) and the same base fabric with Omni-Heat Reflective (OHR).
Figure 4B:
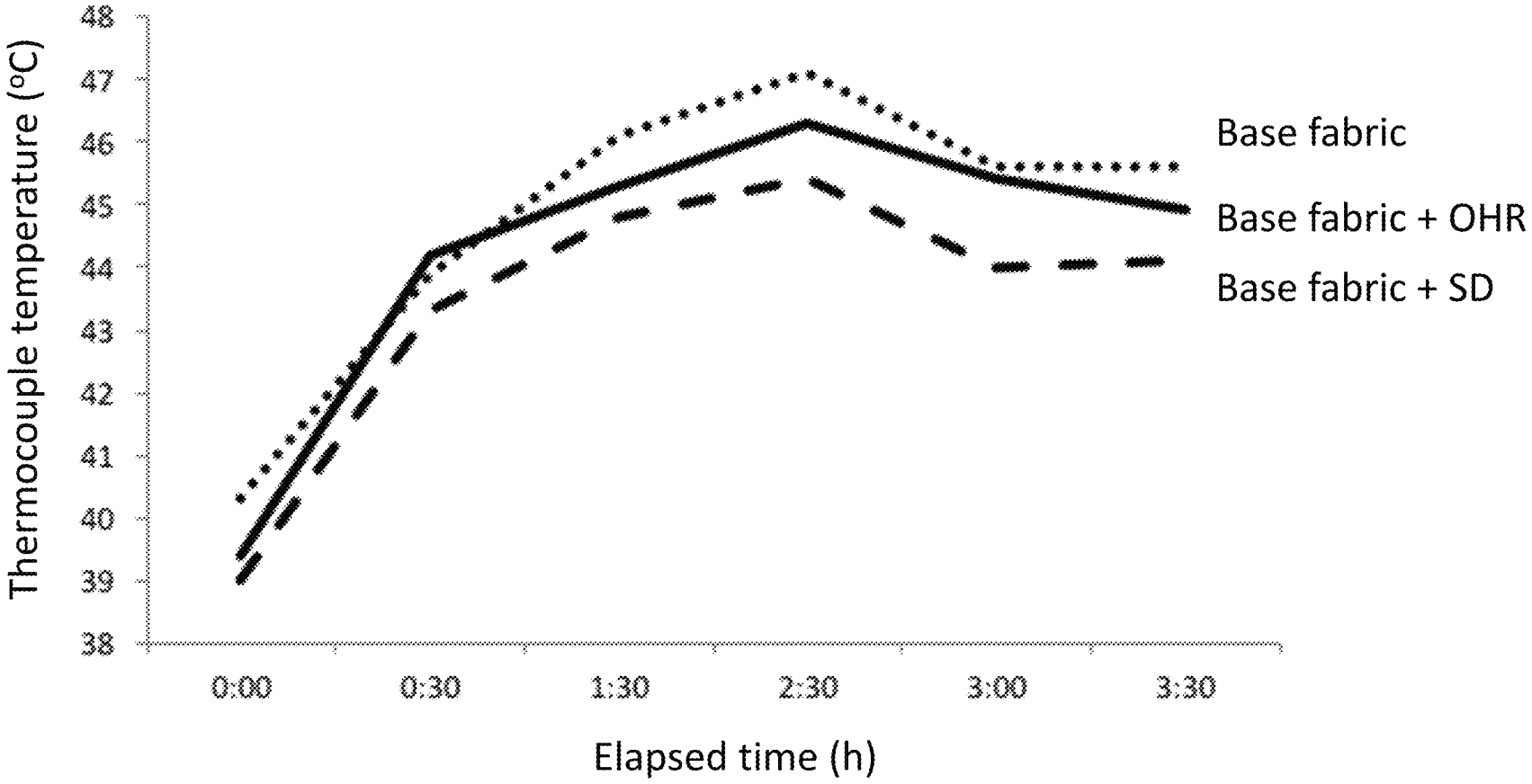

An interesting and unexpected outcome was that the wavelength dependence of the reflection, transmission and emission characteristics of the disclosed multispectral cooling material was so pronounced in comparison to the Omni-Heat fabric. As compared to Omni-Heat fabric, an embodiment of the disclosed multispectral cooling material had a 66% decrease in energy reflection in the 5 μm to 40 μm wavelength range, as well as a 41% increase in energy emission in this wavelength range (see Table 1). The 41% increase in energy emission at a fabric temperature of 35° C. is more substantial than the 6% reduction in solar energy reflected by the multispectral cooling material as compared to the Omni-Heat. As such, even though the Omni-Heat reflects slightly more solar energy than the multispectral cooling material, the multispectral cooling material remains cooler in the direct sunlight due to its combined ability to reflect sunlight and emit more thermal energy to its surroundings as compared to either the Omni-Heat or to the base fabric (FIGS. 4A and 4B).

In contrast to other reflective materials, in embodiments, the multispectral cooling elements used in the disclosed multispectral cooling material (and articles made therefrom) reflect light in the UV, visible, and near IR spectral range, relative to base fabric. In certain embodiments, the multispectral cooling elements also absorb solar light in the ultraviolet spectral range, relative to base fabric. One of the advantages associated with this preferential absorption and/or reflection of light in the UV range is that it minimizes contact by damaging UV rays, which have been shown to damage skin and potentially lead to cancer. For example, in embodiments, as discussed in detail below, the multispectral cooling elements use white pigmented foil, such as a $TiO_2$ foil, that reflects UV, visible, and near IR light, relative to base fabric.

In embodiments, the multispectral cooling elements comprise a white foil pigment. In embodiments, the multispectral cooling elements comprise a metal oxide. Using a white foil having a metal oxide pigment such as a $TiO_2$ pigment, in a discontinuous pattern, to reflect solar rays off the product keeps the product cooler, and by extrapolation, the wearer. The multispectral cooling elements reflects solar radiation in the UV/Vis/near IR thus keeping the base fabric, and the wearer, cooler than without the multispectral cooling elements. In some embodiments, the multispectral cooling elements are relatively small, such as dots that are 1 mm in diameter, so as not to unduly interfere with the performance characteristics of the base fabric. Thus, in various embodiments, a base fabric, for example for body gear, is disclosed that may use a plurality of multispectral cooling elements coupled to the outward facing surface of the base fabric, such as the outward facing surface of the outermost layer of a garment. In an embodiment, a discontinuous pattern of multispectral cooling elements manages body heat by reflecting and reducing transmission of solar spectral energy, and by emitting more body heat compared to the base fabric, while still maintaining the desired moisture and/or heat transfer properties of the base fabric.

Figure 1B:
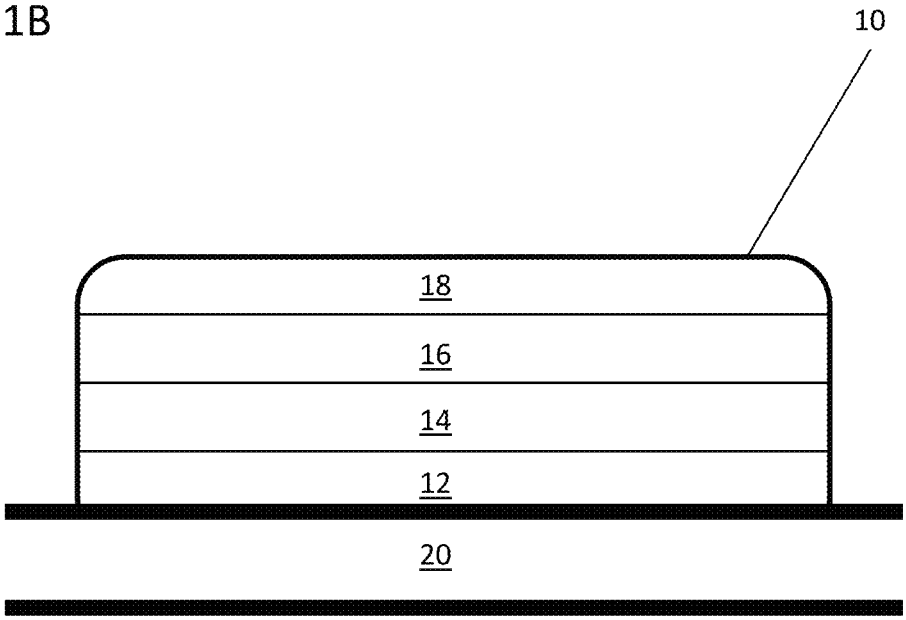
FIG. 1B is a sectional view of one example of a multispectral cooling element, such as a dot or spot, disposed on the exterior facing surface of a base fabric showing an example of material layering, in accordance with various embodiments.

Referring to FIGS. 1A and 1B in embodiments, a plurality of multispectral cooling elements 10 are disposed on the outward facing surface of a base fabric 20 in a generally discontinuous array, whereby some of the base fabric 20 is exposed between adjacent multispectral cooling elements 10. The light reflecting function of the multispectral cooling elements 10 is generally away from the body. The multispectral cooling elements additionally function by inhibiting transmission of solar energy, and by emission of IR radiation away from the body. In various embodiments, the multispectral cooling elements 10 may be arranged in an array of separate elements, whereas in other embodiments, discussed at greater length below, the multispectral cooling elements 10 may be arranged in an interconnected pattern. In some embodiments, a multispectral cooling element 10 may take the form of a solid shape or closed loop member, such as a circle, square, hexagon, or other shape, including an irregular shape. In other embodiments, the discontinuous pattern of multispectral cooling elements 10 may take the form of a lattice, grid, or other interconnected pattern.

Generally, a sufficient surface area of the outward facing surface of base fabric 20 should be exposed to provide the desired base fabric performance characteristic or function (e.g., stretch, drape, texture, breathability, moisture vapor transfer, air permeability, and/or wicking). For example, if there is too little exposed base fabric, properties such as moisture vapor transfer and/or air permeability may suffer, and even disproportionately to the percentage of coverage. As used herein, the term "surface coverage area" refers to a measurement taken from a unit cell, for example, a unit cell can be a region that includes a plurality of multispectral cooling elements. In an example a unit cell is at least a 1 inch by 1 inch unit cell at a given point in the fabric of the discontinuous array of multispectral cooling elements and does not necessarily correspond to the percentage of the entire garment covered by multispectral cooling elements, for example a 1 inch by 1 inch unit cell, a 2 inch by 2 inch unit cell, a 3 inch by 3 inch unit cell and the like. In an example, a unit cell may be the entire exterior surface of a material measured from seam to seam on a given garment.

The multispectral cooling elements 10 cover a sufficient surface area of the outward facing surface of base fabric 20 to generate the desired degree of spectral management (e.g., light reflection away from the body or other covered structure etc., helps reduce heat build-up, for example, when exposed to direct sunlight, such as during a run in the noon-day sun). A sufficient area of outward facing surface of base fabric 20 may be exposed to provide, or maintain, the desired base fabric performance characteristic or function (e.g., breathability, moisture vapor or air permeability, or wicking). In various embodiments, the multispectral cooling elements 10 may cover a sufficient surface area of the base fabric 20 to achieve the desired degree of heat management, for example, having a surface coverage area of the multispectral cooling elements 10 of about 5-90%, about 10-60%, about 15-45%, 20-35%, 20-30% or even about 33% in various embodiments, for example in a specific unit cell, such as a 1 inch by 1 inch unit cell. In a given article or even a portion of the article, the surface area coverage by the multispectral cooling elements may be consistent or it may vary within or across regions of the article.

In embodiments, the individual multispectral cooling elements are about 1 mm in diameter although larger and smaller sizes are contemplated. In embodiments, the individual multispectral cooling elements are in the range from about 0.1 mm in diameter to about 5.0 mm in diameter, such as about 0.1, 0.5, 1.0, 1.5, 2.0, 2.5, 3.0, 3.5, 4.0, 4.5, or 5.0 mm in diameter or any value or range within. In embodiments, the individual multispectral cooling elements in a specific region are spaced apart by about 0.5 mm to about 5.0 mm, such as about 0.5, 1.0, 1.5, 2.0, 2.5, 3.0, 3.5, 4.0, 4.5, or 5.0 mm or any value or range within. As used herein diameter is the average distance from the center of the multispectral cooling elements regardless of shape, for example the geometric center of the multispectral cooling element, such as the center of a circle, triangle, square, polygon, or even an irregular shape. One of ordinary skill the art is capable of determining the geometric center of a shape.

Depending on the physical characteristics of the foil, such as the size and spacing of the particles, such as $TiO_2$ particles, in the foil, the amount of spectral energy, such as UV, visible, or IR spectral energy, that can be transmitted, as opposed to absorbed, and reflected may depend on the thickness of the foil. Thus, in certain embodiments a foil and particle size is selected such that transmittance is minimized while the thickness is also minimized, for example to contain costs and create a material that is aesthetically pleasing. In embodiments, the individual multispectral cooling elements comprise a white foil, wherein the foil, such as a $TiO_2$ pigment containing foil, has a thickness in the range from about 0.1 μm to about 20.0 μm thick, such as about 0.1, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0, 19.5, or 20.0 μm thick, or any value or range within, although lesser and greater thicknesses are also contemplated.

In some embodiments, individual multispectral cooling elements are assembled from particles of solid metal oxides and/or metalloid oxides deposited on a flat layer constructed from a monolithic metal, metal oxide, and/or metalloid oxide. Potentially any light that gets through the layer(s) of particles would be reflected back by the monolithic reflective material below. In embodiments, the individual multispectral cooling elements are a monolithic material, e.g. metal film or continuous slab. In embodiments, the individual multispectral cooling elements are a layer of particles, e.g. metal oxide particles of various type and size.

In embodiments, the multispectral cooling elements are constructed from a collection of non-uniformly sized particles with average sizes ranging from less than approximately 250 nm to approximately 4,000 nm, for example less than 250 nm, about 250 nm, about 300 nm, about 350 nm, about 400 nm, about 450 nm, about 500 nm, about 550 nm, about 600 nm, about 650 nm, about 750 nm, about 800 nm, about 850 nm, about 900 nm, about 950 nm, about 1000 nm, about 1250 nm, about 1500 nm, about 1750 nm, about 2000 nm, about 2500 nm, about 3000 nm, about 3500 nm, or about 4000 nm. The distribution of particle sizes may be random or non-random. It is also preferred that the particles be selected, or prepared, to contain fewer, larger continuous geometric regions such as facets or grain boundaries.

In certain embodiments, the multispectral cooling elements include one or more binders or other agents to hold the particles, such as pigment particles, together. Typically, such binders would make up less than 50% of the total volume of a multispectral cooling element, such as less than 45%, less than 40%, less than 35%, less than 30%, less than 25%, less than 20%, less than 20%, less than 15% or even less than 10% of the total, by weight or volume of a multispectral cooling element.

In certain embodiments, the crystal structure of a metal oxide contributes to the reflective properties of the multispectral cooling elements. For example, $TiO_2$ is available in two crystal forms, anatase and rutile. Thus in certain embodiments, the multispectral cooling elements include anatase $TiO_2$ and/or rutile $TiO_2$ crystals. Typically, the rutile pigments are preferred over anatase pigments, because they scatter light more efficiently, are more stable, and are less likely to catalyze photodegradation.

Unlike colored pigments that provide opacity by absorbing visible light, $TiO_2$ and other white pigments provide opacity by scattering light, which leads to the reflectance observed with the materials and fabrics disclosed herein.

As disclosed herein the pigment level and composition may be selected such that the solar light striking the surface of the fabric, except for the small amount absorbed by the polymer or pigment, will be scattered outward or, in other words reflected. This light scattering is accomplished by refraction and diffraction of light as it passes through or near pigment particles.

High refractive index materials, such as white pigments are better able to bend light and therefore are desired for the materials disclosed herein. By way of example in a foil containing a high refractive index pigment, such as $TiO_2$, light is bent more than in the film containing the low refractive index material. The result is that light travels a shorter path in the foil and does not penetrate as deeply. This may result in less absorption of heat in a fabric with high refractive index pigments, such as those disclosed herein. By using a high refractive index material, such as a white pigment particle, thinner films or foils are needed than if a low refractive index material were used. In certain embodiments, a white pigment particle has a refractive index between about 2.0 and about 2.75, and even greater for certain wavelength ranges.

In general, the greater the difference between the refractive index of the pigment and that of the polymer matrix in which it is dispersed, the greater the light scattering.

Diffraction is another factor affecting the degree to which a pigment scatters light. As light passes near a pigment particle, it is bent. Generally, for the most effective light scattering, the pigment diameter should be slightly less than one-half the wavelength of light to be scattered. In addition, spacing of the particles also has an effect on diffraction. Thus, particles that are too large or small do not effectively diffract light, while particles that are too closely spaced tend to interfere with diffraction. Thus, selection of both the particle size and spacing is an important factor in the design of the materials and fabrics disclosed herein.

Figure 1C:
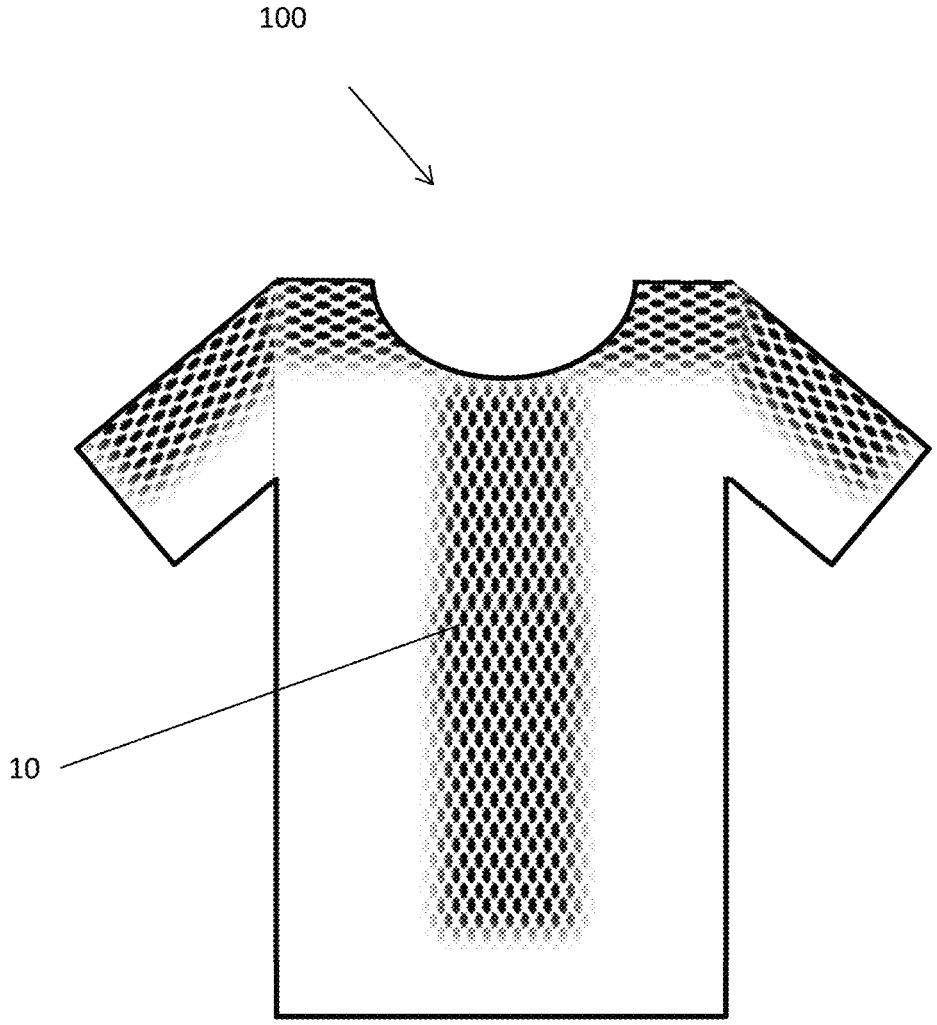
FIG. 1C illustrates an upper body garment, such as a shirt, having a discontinuous pattern of multispectral cooling elements disposed on the exterior facing surface of a base fabric, in accordance with various embodiments.
Figure 2A:
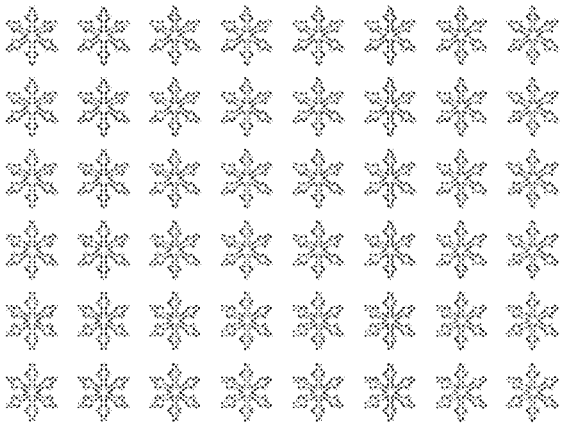
FIGS. 2A-2H illustrate examples of discontinuous patterned multispectral cooling elements disposed on the exterior facing surface of a base fabric, in accordance with various embodiments.
Figure 2B:
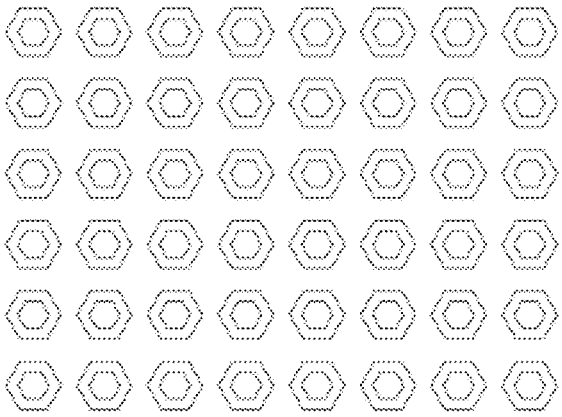
Figure 2C:
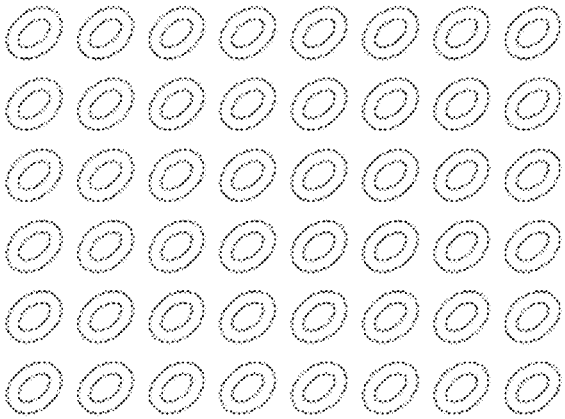
Figure 2D:
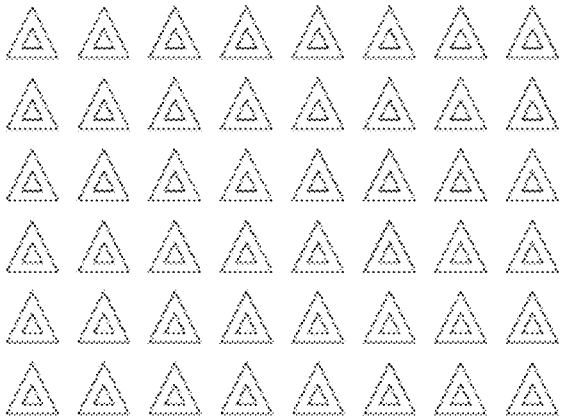
Figure 2E:
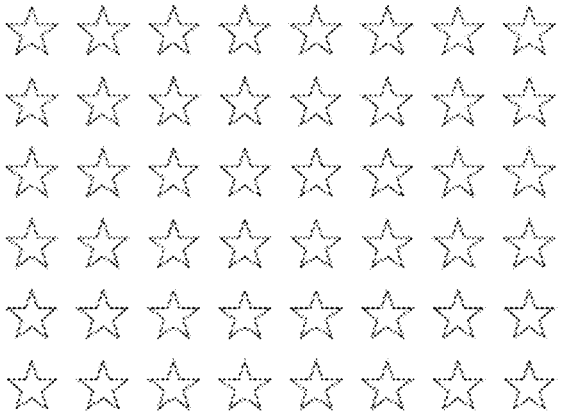
Figure 2F:
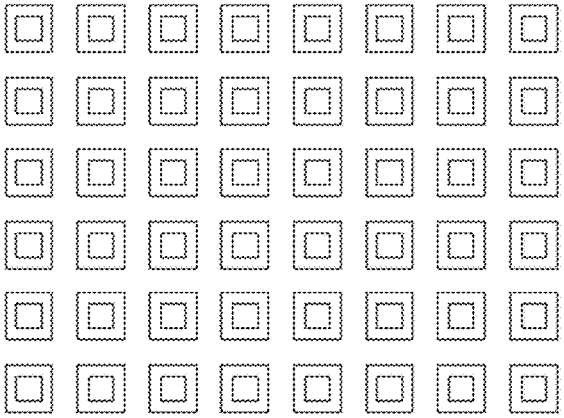
Figure 2G:
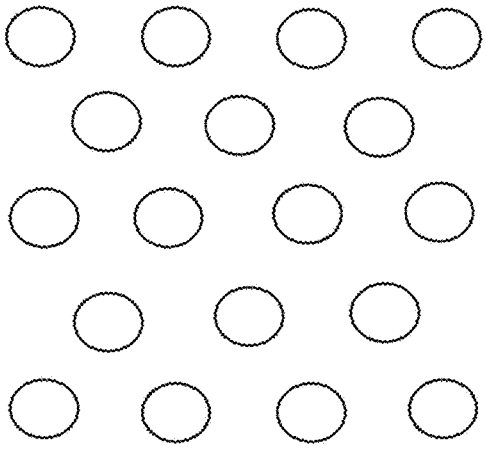
Figure 2H:
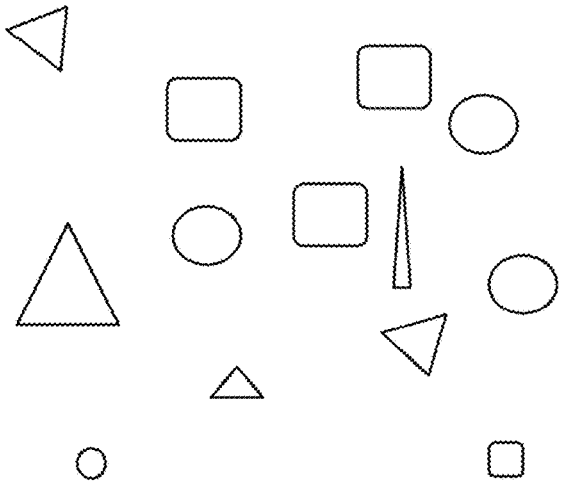
Figure 3A:
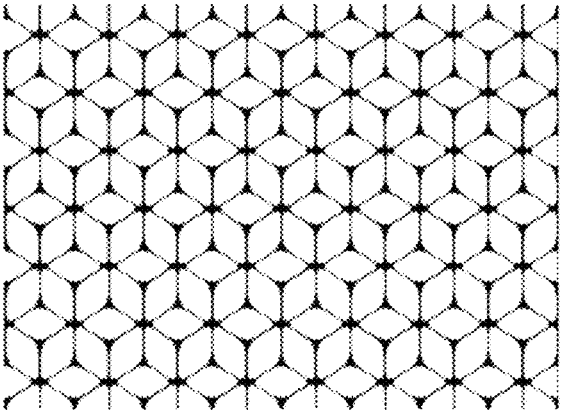
FIGS. 3A-3F illustrate examples of patterned multispectral cooling elements disposed on the exterior facing surface of a base fabric, in accordance with various embodiments.
Figure 3B:
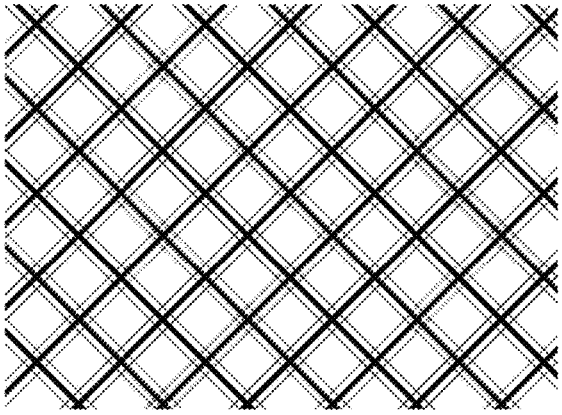
Figure 3C:
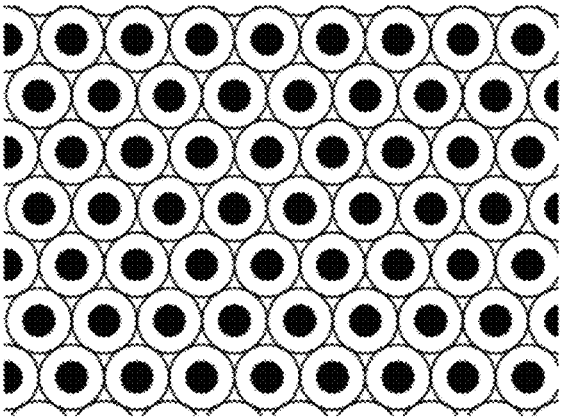
Figure 3D:
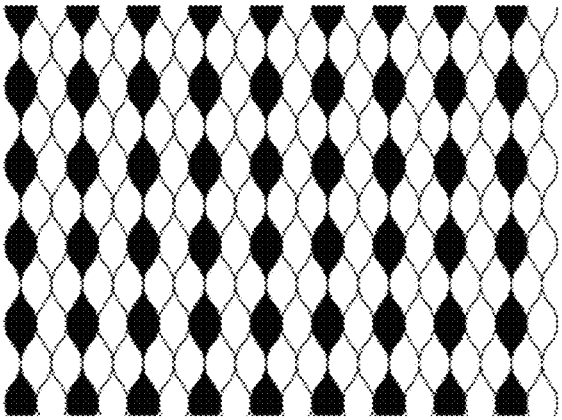
Figure 3E:
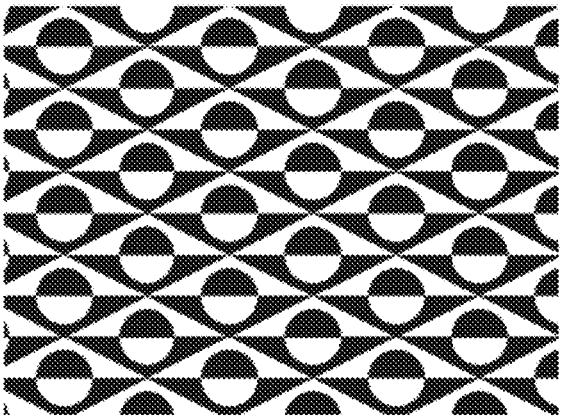
Figure 3F:
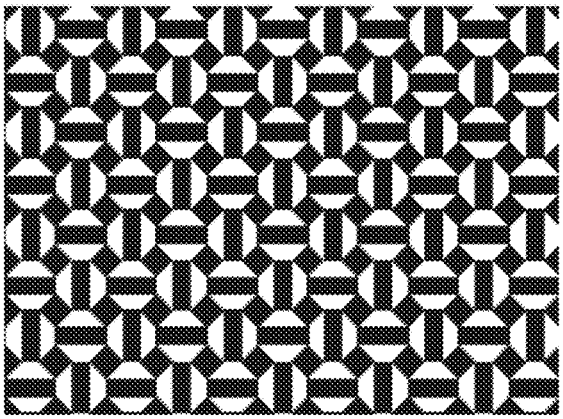

The multispectral cooling elements 10 are disposed on the exterior surface of the body gear and/or outermost facing surface of a base fabric 20 such that they are exposed to the environment, which may allow the multispectral cooling elements 10, for example, to reflect solar light away from the user, while allowing the base fabric 20 to adequately perform its desired functions. In some embodiments, the multispectral cooling elements 10 may perform these functions without adversely affecting the drape, feel, or other properties of the base fabric. In accordance with various embodiments, the base fabric 20 may be a part of any form of body gear, such as bodywear (see e.g., FIG. 1C, which shows shirt 100 having a discontinuous array of multispectral cooling elements 10 disposed thereon), blankets, tents, rain flys, umbrellas, meshes, boat and vehicle covers, rubber and raft materials, awnings, or sun shade fabrics, or any material or apparatus where light reflectance is desired. Bodywear, as used herein, includes anything worn on the body, such as, but not limited to, athletic wear such as compression garments, t-shirts, shorts, tights, sleeves, headbands and the like, outerwear, such as jackets, pants, leggings, shirts, hats, and the like, and footwear.

In various embodiments, the multispectral cooling elements 10 may be disposed in a discontinuous array on both the outward facing surface and the inward facing surface of a base fabric 20 having one or more desired properties or characteristics. The disposed multispectral cooling elements 10 may or may not be in register with each other on the opposing face of the fabric. The base fabric 20 may be open and air permeable, such as in a mesh, so that the embodiment exhibits both high light reflectance and high air and moisture vapor permeability, or breathability. In such an embodiment, even though the multispectral cooling elements are disposed on the inward-facing surface of the base fabric, they are intended to reflect solar radiation, through the gaps between the multispectral cooling elements disposed on the outward-facing surface of the base fabric, just as the multispectral cooling elements on the outward-facing surface of the base fabric.

In various embodiments, the multispectral cooling elements 10 may be disposed on the outward facing surface of base fabric 20 having one or more desired properties or characteristics. For example, the base fabric 20 may have properties such as air permeability, moisture vapor transfer, and/or wickability, which are common needs for bodywear used in both indoor and outdoor applications. In some embodiments, the base fabric 20 may have other desirable attributes, such as abrasion resistance, anti-static properties, anti-microbial activity, water repellence, flame repellence, hydrophilicity, hydrophobicity, wind resistance, solar protection, SPF protection, resiliency, stain resistance, wrinkle resistance, and the like. In other embodiments, the separations between multispectral cooling elements 10 help allow the exterior facing surface of a base fabric 10 to have a desired drape, look, and/or texture. Suitable base fabrics may include nylon, polyester, polypropylene, rayon, cotton, spandex, wool, silk, or a blend thereof, or any other material having a desired look, feel, weight, thickness, weave, texture, or other desired property. In various embodiments, allowing a designated percentage of the base fabric to remain uncovered by the multispectral cooling elements may allow that portion of the base fabric to perform the desired functions, while leaving enough multispectral cooling element surface area to direct solar light in a desired direction, for instance away from the body of a user.

In various embodiments, a single layer of base fabric 20 may be used comprising the base fabric 20 including an exterior facing surface upon which the multispectral cooling elements are disposed 10, whereas other embodiments may use multiple layers of fabric, including a layer of the base fabric 20, coupled to one or more other layers, where the base fabric 20 is the exterior layer with an exterior facing surface upon which the multispectral cooling elements 10 are disposed. In certain embodiments, the individual multispectral cooling elements are individually coupled, such as glued, and/or bonded to the base fabric. In certain embodiments, multispectral cooling elements are directly coupled to the base fabric.

As illustrated in FIG. 1B, the multispectral cooling elements 10 are positioned on the outermost surface of the base fabric 20. In embodiments, the multispectral cooling elements 10 reflect solar light, limit solar energy transmission, and emit thermal radiation at wavelengths comparable to that of the human body thus keeping the base fabric 20, and the wearer, cooler than without the multispectral cooling elements 10. In the embodiment shown, the multispectral cooling elements 10 are applied in a manufacturing process in which several layers of material 12, 14, 16, and 18 are first used/applied. In certain embodiments, the layers include a polyethylene terephthalate (PET) layer 12, a white pigmented layer (for example including as the main pigment $TiO_2$) 14, and one or more release layers 16, 18. In some embodiments the one or more release layers include an acrylate release layer 16, and optionally an additional release layer 18, which helps stop the glue from a roller process from penetrating through the foil layer 14, and causes a hard release when the foil is pulled from the base fabric 20. In certain embodiments, the PET has a thickness of between about 5 microns and about 25 microns such as 12 microns, and about 10 to about 20 g/m$^2$, such as about 16.7 g/m$^2$. In certain embodiments, the acrylate release layer is approximately 0.1 to 1.0 g/m$^2$, such as about 0.5 g/m$^2$. In certain embodiments, the white pigmented layer is approximately 10.0 to 20.0 g/m$^2$, such as about 12 g/m$^2$.

In various embodiments, the multispectral cooling elements 10 may be permanently coupled to the base fabric 20 in a variety of ways, including, but not limited to gluing, heat pressing, printing, or stitching. In some embodiments, the multispectral cooling elements 10 may be coupled to the base fabric 20 by frequency welding, such as by radio or ultrasonic welding. In some embodiments, the multispectral cooling elements 10 may be coupled to the base fabric using gravure coating. In some specific, non-limiting examples, the gravure coating process may use an engraved roller running in a coating bath, which fills the engraved dots or lines of the roller with the coating material (e.g., the gel making up the multispectral cooling elements 10). The excess coating on the roller may be wiped off using a blade, and the coating may then be deposited onto the substrate (e.g., the base fabric 20) as it passes between the engraved roller and a pressure roller. In various embodiments, the gravure coating process may include direct gravure, reverse gravure, or differential offset gravure, and in various embodiments, the coat weight may be controlled by the percent of solids, the gravure volume, the pattern depth, and/or the speed of the gravure cylinder.

In various embodiments, the multispectral cooling elements may be applied in a pattern or a continuous or discontinuous array. For example, as illustrated in FIGS. 2A-2H, the multispectral cooling elements may take the form of an array of discrete solid or closed loop members, adhered or otherwise secured to the base fabric in a desired pattern. Such a configuration has been found to provide cooling to the user while still allowing the base fabric to perform desired properties (e.g., breathe and stretch). In various embodiments, such discontinuous, discrete, separate multispectral cooling elements may take the form of circles, triangles, squares, pentagons, hexagons, octagons, stars, crosses, crescents, ovals, or any other suitable shape.

Although the embodiments illustrated in FIGS. 2A-2H show the multispectral cooling elements as separate, discrete elements, in some alternate embodiments, some or all of the multispectral cooling elements may be arranged such that they are in connection with one another, such as stripes, wavy lines, or a matrix/lattice pattern or any other pattern that permits partial coverage of the base fabric. For example, as illustrated in FIGS. 3A-3F, the configuration of the multispectral cooling elements disposed on a base fabric may be in the form of a variety of partially or completely connected elements, and the pattern may combine both discontinuous elements (such as those illustrated in FIGS. 2A-2H) and interconnected geometrical patterns (such as those illustrated in FIGS. 3A-3F). In various embodiments, the pattern of multispectral cooling elements may be symmetrical, ordered, random, and/or asymmetrical. Further, as discussed below, the pattern of multispectral cooling elements may be disposed on the base fabric at strategic locations to improve the performance of bodywear (see, for example, FIG. 1C). In various embodiments, the size and/or spacing of the multispectral cooling elements may also be varied in different areas of the bodywear to balance the need for enhanced multispectral reflective properties in certain regions while preserving the functionality of the base fabric.

In various embodiments, the placement, pattern, and/or coverage ratio of the multispectral cooling elements may vary. For example the multispectral cooling elements may be concentrated in certain areas where reflection may be more critical (e.g., the shoulder or front and back of the torso in the case of a shirt or jacket) and non-existent or extremely limited in other areas where the function of the base fabric property is more critical or solar light reflection is not needed (e.g. the underside of the arms or the sides of the torso covered by the arms). In various embodiments, different areas of the bodywear may have different coverage ratios, e.g. 70% at the shoulders, back, and chest and 5% or less on the undersides of the arms or the bottom of a tent, in order to help optimize, for example, the need for cooling and breathability. Of course the coverage locations and ratios can change depending on the type of garment. For example, a rash guard used for surfing may have a different coverage pattern than a shirt used for running. In some embodiments, the degree of coverage by the multispectral cooling elements may vary in a gradual fashion over the entire garment as needed for regional cooling.

In various embodiments, the pattern of multispectral cooling elements may be symmetrical, ordered, random, and/or asymmetrical. Further, as discussed below, the pattern of multispectral cooling elements may be disposed on the exterior facing surface of a base fabric at strategic locations to improve the performance of the body wear. In various embodiments, the size of the multispectral cooling elements may also be varied to balance the need for enhanced multispectral reflective properties and to preserve the functionality of the base fabric.

Example 1

This example illustrates a comparison of the heat-managing properties of several fabrics including an Omni-Freeze Zero base fabric (100% polyester blue interlock knit with Omni-Freeze Zero, 140 gsm), the same base fabric having a discontinuous array of multispectral cooling elements coupled thereto, and the same base fabric having a discontinuous array of silver reflective elements coupled thereto (i.e., Omni-Heat Reflective). The multispectral cooling elements were included as a white foil comprising $TiO_2$. The silver reflective elements were included as a silver foil comprising aluminum. The surface-area coverage of the multispectral cooling elements and the silver reflective foil was approximately 30%, respectively. The fabrics were secured with rubber bands over the tops of rectangular plastic containers (12.5"×7.5"×4.25") that were about one-third-filled with water. Thermocouples were affixed inside the plastic containers just below each fabric, and the containers were positioned outside for even sun exposure. The temperatures under the different fabrics were determined as a function of time, as illustrated in FIG. 4A and FIG. 4B, which represent data collected on different days and times, respectively. The base fabric with multispectral cooling elements significantly outperformed the same base fabric with no multispectral cooling elements. The base fabric with multispectral cooling elements also, surprisingly, outperformed the same base fabric with silver reflective foil. In short, these data provide solid quantitative support and reveal that solar deflector (SD), as compared to the base fabric, is cooler as a function of time. Unexpectedly, the same observation was made when comparing the solar deflector (SD) to Omni-Heat Reflective (OHR) fabric (silver elements) with the same surface coverage on the same base fabric.

Example 2

This example shows direct comparisons of spectral reflectance, transmittance, and emittance between solar deflector (SD) (according to embodiments disclosed herein), base fabric, and/or Omni-Heat Reflective fabric.

Figure 5:
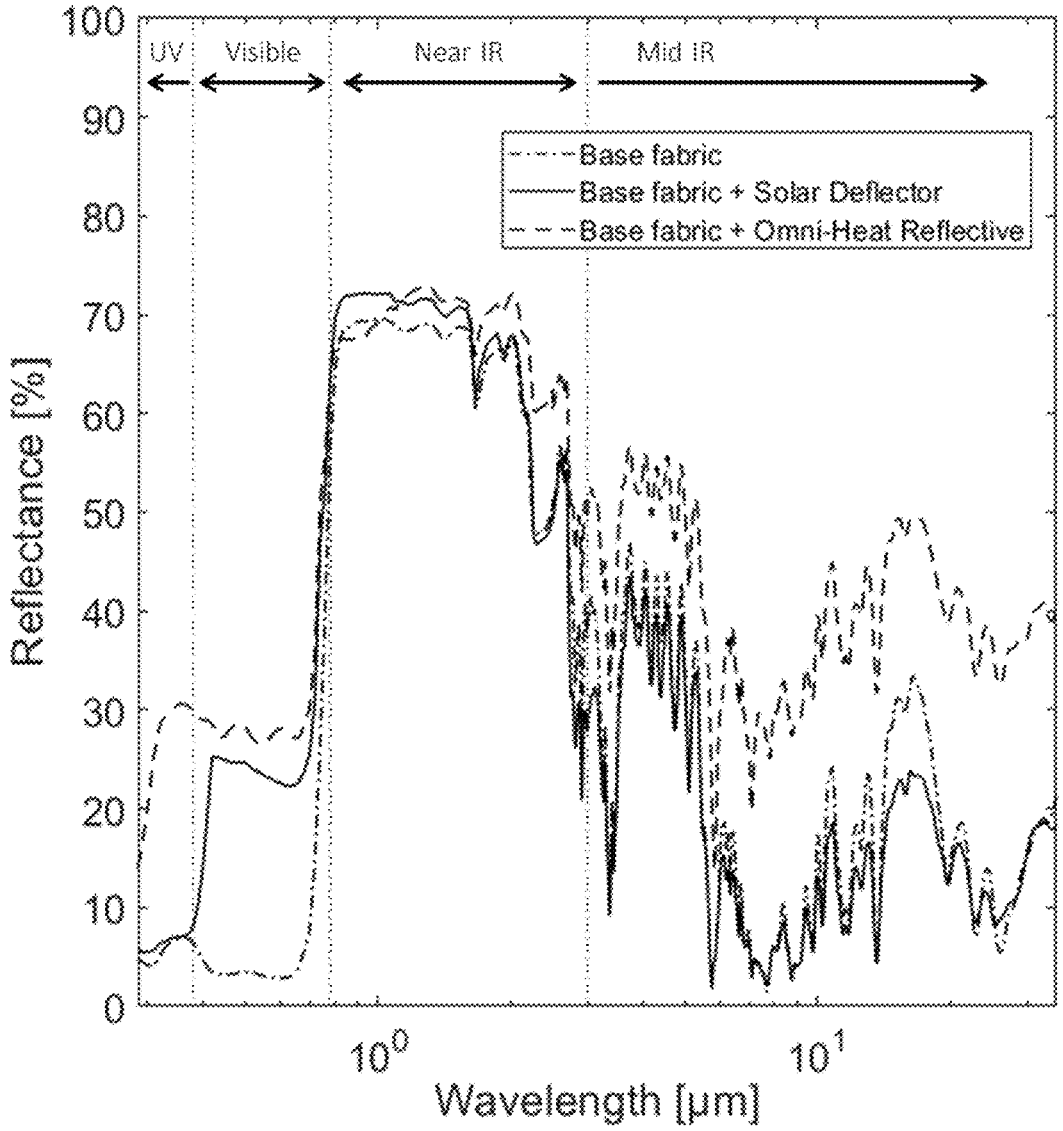
FIG. 5 is a graph showing the full spectrum reflectance data for solar deflector fabric (SD), Omni-Heat Reflective (OHR), and base fabric. Data presented for the entire spectrum with a logarithmic x-axis scale to improve visualization at small wavelengths.

As shown in FIG. 5, solar deflector (SD), Omni-Heat Reflective and base fabric samples were tested to measure reflectance across the ultraviolet, visible, and infrared spectral regions. Spectral measurements in the ultraviolet, visible, and near IR wavelength range ($0.25<\lambda<2.5$ μm) were conducted using a LPSR 300 spectrophotometer, in general accordance with ASTM E903. Spectral measurements from 2.5-40 μm were conducted using a Nicolet iS50 FTIR spectrophotometer with a Pike Upward MID integrating sphere, in general accordance with ASTM E408. The average spot size for each measurement: rectangular spot ca. 7.6 mm×2 mm for UV/Vis/NIR (0.25-2.5 μm); elliptical spot ca. 8.5 mm×7.5 mm for MIR (2.5-40 μm). In both instruments, the measurement spot size was determined to be sufficiently large relative to the circular elements such that the measurement represented an average of the spectral response for the multi-material (i.e., fibers and elements) fabric surface. This was verified by considering the deviation between measurements from three samples taken in different positions in each instrument.

Spectral reflectance and transmittance were measured on three samples of each of the base fabric, solar deflector, and Omni-Heat fabrics. The black base fabric for the solar deflector and Omni-Heat samples was identical which allows a direct comparison between the two materials. The front surface of both fabrics contained circular elements of approximately the same diameter, evenly spaced on the fabric with a similar surface coverage of approximately 30% (see Table below). Optical microscopy and ImageJ analysis (Available on the world wide web at imagej.nih.gove/ij/) were used to measure element size and surface area coverage. The % coverage ($\varphi$) was calculated as $\varphi=100\times(2\times(0.25\pi D^2)/L^2)$, where D is the average circular element diameter, L is the average linear distance of the unit square, and there are 2 circular elements per unit cell (reported values for L and D were an average of 12 independent measurements on each fabric sample).

| | D (μm) | L (μm) | Surface area coverage, $\phi$ |
|---|---|---|---|
| SD | 904 | 2091 | 29.4% |
| OH | 990 | 2268 | 29.9% |

ASTM G173 provides the solar spectrum at the earth's surface. The fraction of total solar power in the UV region is 3.2% (UVA and UVB, 0.28-0.38 μm), 53.4% in the visible region (0.38-0.78 μm), and 43.4% in the near IR region (0.78-3.0 μm). Effectively all solar energy is contained in wavelengths <2.5 μm (see FIG. 6).

Figure 7:
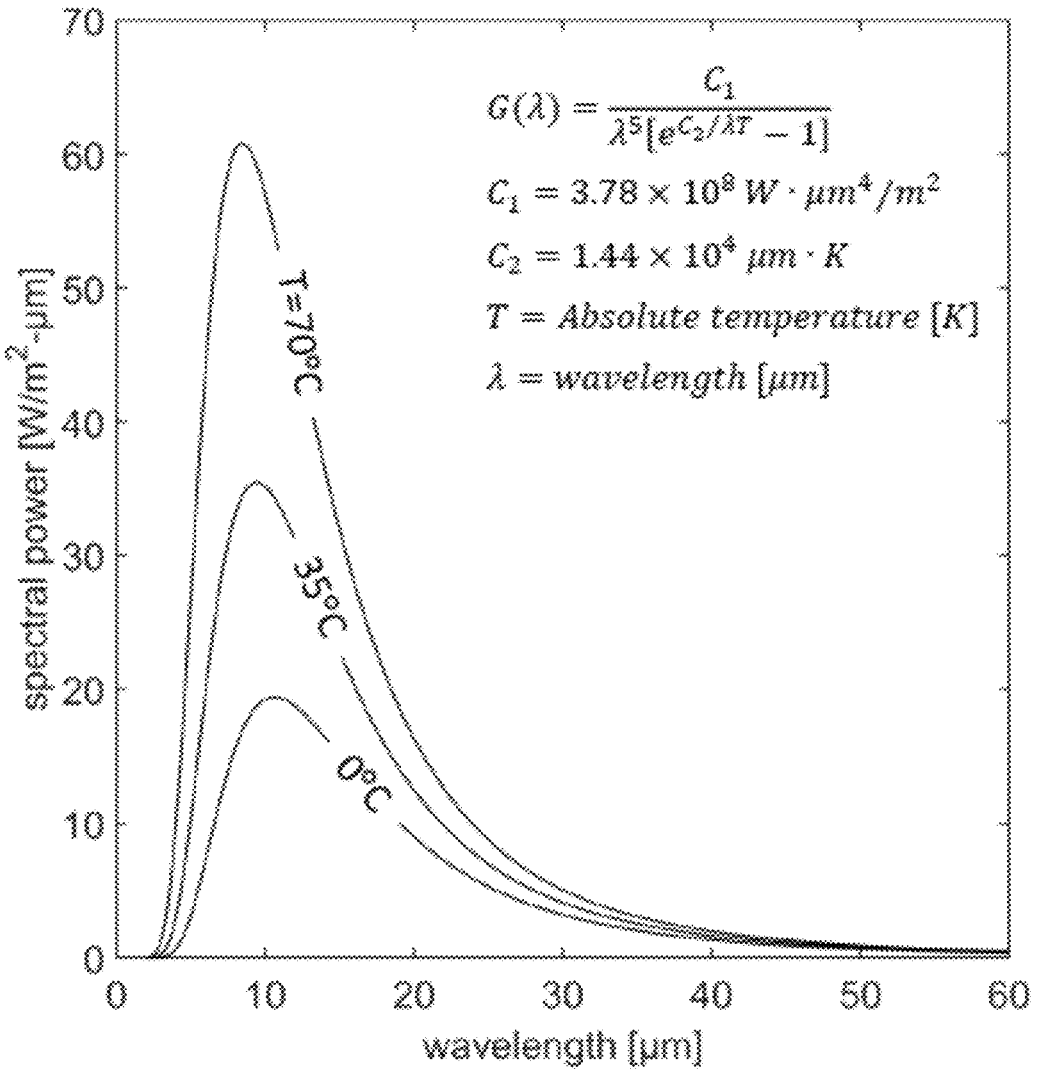
FIG. 7 is a graph of the Boltzmann distribution of the blackbody emission at various temperatures.

A Boltzmann distribution provides the radiation emitted by a blackbody surface at a given absolute temperature (see FIG. 7): at typical surface temperatures (0-70° C.), peak emission is at ~10 μm. Surface emission is much less intense, but far broader than solar irradiation. At nominal skin temperature (35° C.), ca. 95% of the emitted energy by a blackbody is contained within the spectral region $5\leq\lambda\leq40$ μm.

Figure 8:
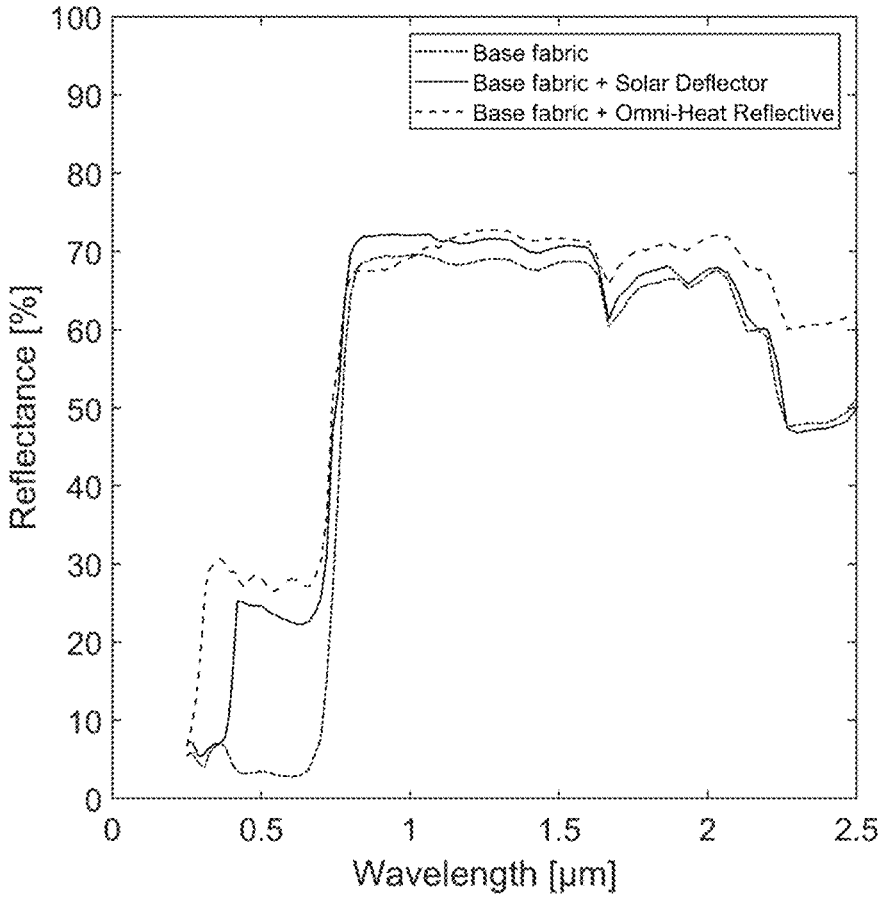
FIG. 8 is a graph of spectroscopic reflectance measurements from $0.25<\lambda<2.5$ μm for solar deflector (SD), Omni-Heat, and base fabric.

The reflectance solar spectra ($0.25\leq\lambda\leq2.5$ μm) are shown in FIG. 8 for a black base fabric, solar deflector and Omni-Heat Reflective fabrics. These measured reflectance data were used to determine the weighted average reflectance ($\rho$) and reflected energy ($E_\rho$) shown in the Table below.

| | UV & Visible Only (0.25-0.78 μm) | | Full Solar Region (0.25-2.5 μm) | |
|---|---|---|---|---|
| | $\bar{\rho}_{UVV}$ | $E_{\rho,UVV}\left[\frac{W}{m^2}\right]$ | $\bar{\rho}_s$ | $E_{\rho,s}\left[\frac{W}{m^2}\right]$ |
| Solar Deflector | 24.5% | 135.6 | 44.3% | 435.3 |
| Omni-Heat | 30.4% | 167.8 | 47.3% | 464.7 |
| Base Fabric | 6.8% | 37.4 | 33.1% | 325.4 |

$$\bar{\rho}=\frac{\int\rho(\lambda)\cdot G(\lambda)\cdot d\lambda}{\int G(\lambda)\cdot d\lambda} \qquad E_\rho=\int\rho(\lambda)\cdot G(\lambda)\cdot d\lambda$$

*(where G(λ) is the solar spectrum given by ASTM G173)*

$E_{\rho,UVV}$ is the total solar energy reflected between 0.25-0.78 μm. $E_{\rho,s}$ is the total solar energy reflected between 0.25-2.5 μm. As shown in FIG. 8, the solar deflector fabric exhibited a higher reflectance (44.3%) averaged across the entire solar region than the base fabric (33.1%). The largest reflectance difference is evident in the UV and visible portions of the spectra, wavelengths less than approximately 0.78 μm, in which the solar deflector reflectance is 24.5% and the base fabric is 6.8%. Though Omni-Heat exhibits slightly higher reflectance in the UV, visible, and near IR wavelength regions than the solar deflector material, it also exhibits the highest reflectance in the mid IR region (greater than about 3 μm, see FIG. 5) which corresponds to a reduced ability to emit infrared energy at these wavelengths (see FIG. 11), and consequently a reduced ability to cool as compared to the solar deflector material.

Figure 9:
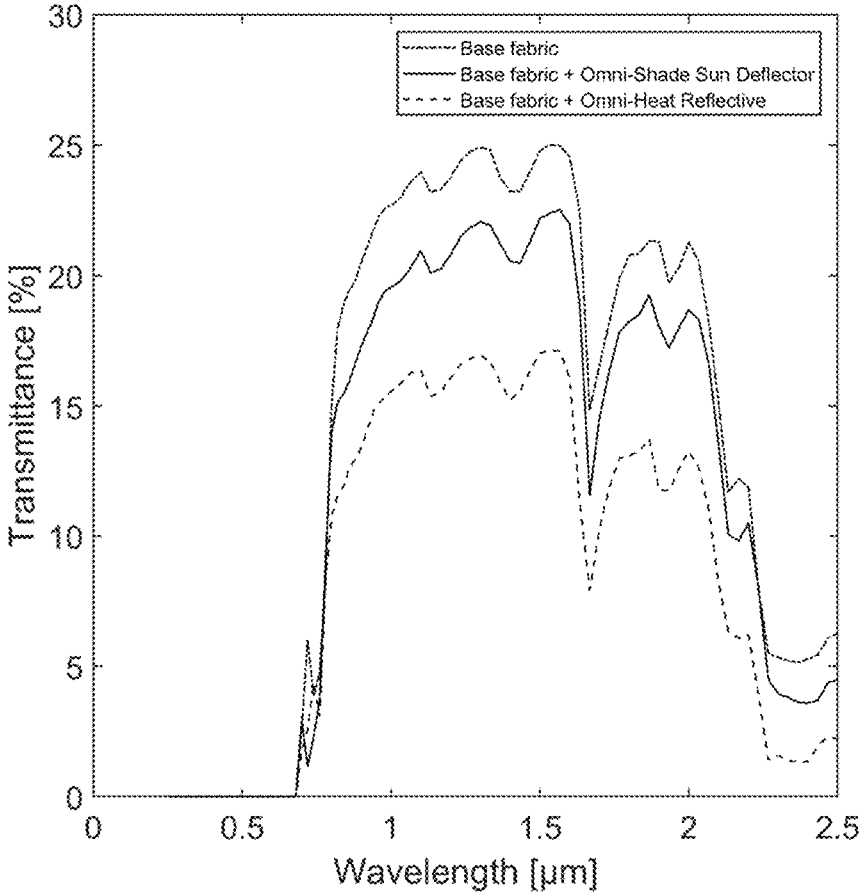
FIG. 9 is a graph of spectroscopic transmittance measurements from $0.25<\lambda<2.5$ μm for solar deflector (SD), Omni-Heat, and base fabric.

As shown in FIG. 9, the solar deflector has lower transmittance in the infrared portion of the solar spectrum than the base fabric. This will result in less solar irradiation reaching the wearer's skin.

Weighted average transmittance ($\tau$) and transmitted energy ($E_\tau$) values are shown in the Table below.

| | Near IR Only (0.78-2.5 μm) | | Full Solar Region (0.25-2.5 μm) | |
|---|---|---|---|---|
| | $\bar{\tau}_{NIR}$ | $E_{\tau,NIR}\left[\frac{W}{m^2}\right]$ | $\bar{\tau}_S$ | $E_{\tau,s}\left[\frac{W}{m^2}\right]$ |
| Solar Deflector | 17.8% | 76.4 | 8.1% | 79.2 |
| OmniHeat | 13.6% | 58.6 | 6.3% | 61.7 |
| Base Fabric | 20.5% | 88.2 | 9.4% | 92.2 |

$$\bar{\tau}=\frac{\int\tau(\lambda)\cdot G(\lambda)\cdot d\lambda}{\int G(\lambda)\cdot d\lambda} \qquad E_\tau=\int\tau(\lambda)\cdot G(\lambda)\cdot d\lambda$$

*(where G(λ) is the solar spectrum given by ASTM G173)*

$E_{\tau,NIR}$ is the total solar energy transmitted in the near IR region between 0.78-2.5 μm. $E_{\tau,s}$, is the total solar energy transmitted in the full solar spectrum between 0.25-2.5 μm. The total average transmittance in the near IR is 17.8% for solar deflector and 20.5% for the base fabric.

FIG. 10 shows the reflectance and FIG. 11 shows the emittance in the mid IR (MIR) spectral region ($5\leq\lambda\leq40$ μm), the region corresponding to emission from human skin. As shown in FIGS. 10 and 11, solar deflector has lower reflectance and higher emittance than Omni-Heat at wavelengths corresponding to emission from human skin. Thus, Omni-Heat will reflect more body energy, and in contrast solar deflector will more efficiently cool itself than Omni-Heat by emitting more infrared energy.

Weighted average reflectance ($\rho_{skin}$) and reflected energy ($E_{\rho,skin}$) values from skin at 35° C., as well as weighted average emittance ($\varepsilon_{fabric}$) and emitted energy ($E_{\varepsilon,fab}$) values from the fabric at 35° C. are shown in the Table below.

| | Reflection from 35° C. Skin | | Fabric Emission at 35° C. | |
|---|---|---|---|---|
| | $\bar{\rho}_{skin}$ | $E_{\rho,skin}\left[\frac{W}{m^2}\right]$ | $\bar{\varepsilon}_{fabric}$ | $E_{\varepsilon,fab}\left[\frac{W}{m^2}\right]$ |
| Solar Deflector | 13.0% | 60.5 | 87.0% | 412.7 |
| Omni-Heat | 38.3% | 179.0 | 61.7% | 292.5 |
| Base Fabric | 15.8% | 74.0 | 84.2% | 399.0 |

$$\bar{\varepsilon}_{fabric} = \frac{\int \varepsilon(\lambda)\cdot G(\lambda)\cdot d\lambda}{\int G(\lambda)\cdot d\lambda} \qquad E_{\varepsilon,fab} = \int \varepsilon(\lambda)\cdot G(\lambda)\cdot d\lambda$$

(where $G(\lambda)$ is the Boltzmann blackbody distribution at 35° C.)

The skin reflection calculations assume skin is emitting at a temperature of 35° C. like a grey body in the MIR with emissivity=0.985. Thus, $E_{\rho,skin}$ represents the total energy reflected from the skin between wavelengths of 5 and 40 μm. By Kirchoff's law, spectral emittance ($\varepsilon(\lambda)$) is equal to the spectral absorptance ($\alpha(\lambda)$). The fabrics are nominally opaque ($\tau=0$) for $5\leq\lambda\leq40$ μm, therefore $\alpha(\lambda)=1-\rho(\lambda),=\varepsilon(\lambda)$.

As shown in the table above, the solar deflector emits roughly 14 W/m$^2$ more than the base material and approximately 120 W/m$^2$ more than the Omni-Heat material at a fixed temperature of 35° C. This indicates that, even though the Omni-Heat reflects slightly more solar energy than the solar deflector (464.7 vs 435.3 W/m$^2$), and transmits slightly less solar energy (61.7 vs. 79.2 W/m$^2$), the overall performance (in terms of mitigating and dissipating heat from the sun) of the solar deflector is better than the Omni-Heat. In the case of the base material, the solar deflector is both better at reflecting solar energy and emitting heat to its surroundings. This is consistent with the results presented in FIGS. 4A and 4B, where the solar deflector remains cooler when exposed to direct sunlight than both the Omni-Heat and the base material.

The above determinations were converted to percentage differences as tabulated below.

TABLE 1

Solar Deflector Energy Exchange Ratios

| SD Relative to: | Total Solar Energy Reflection 0.25-2.5 μm | UV/Vis Solar Energy Reflection 0.25-0.78 μm | Total Solar Energy Transmission 0.25-2.5 μm | Near IR Solar Energy Transmission 0.78-2.5 μm | Skin Energy Reflection 5 and 40 μm | Energy Emission at T = 35° C. 5 and 40 μm |
|---|---|---|---|---|---|---|
| Omni-Heat | 6% decrease | 19% decrease | 28% increase | 30% increase | 66% decrease | 41% increase |
| Base Fabric | 34% increase | 263% increase | 14% decrease | 13% decrease | 18% decrease | 3% increase |

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

We claim:

1. A multispectral cooling material adapted for use with bodywear, comprising:

a base fabric having an externally facing surface and having a performance characteristic; and one or more multispectral cooling elements coupled to the externally facing surface of the base fabric, the one or more multispectral cooling elements comprising a discontinuous array of foil elements containing metal oxide particles and a polymeric binder, wherein the foil elements have a thickness from about 0.1 μm to about 20.0 μm, wherein the placement and spacing of the one or more multispectral cooling elements leaves a portion of the base fabric uncovered and enables the base fabric to retain at least partial performance of the performance characteristic, and wherein the multispectral cooling material reflects greater than 50% more of the solar energy in the 0.25 μm to 0.78 μm wavelength range compared to the base fabric alone, has a greater than 10% reduction in transmitted solar energy in the 0.25 μm to 2.5 μm wavelength range compared to the base fabric alone, and has a greater than 1%, increase in energy emission in a 5 μm to 40 μm wavelength range compared to the base fabric alone.

2. The multispectral cooling material of claim 1, wherein the multispectral cooling material reflects greater than 5% more of the solar energy in the 0.25 μm to 2.5 μm wavelength range compared to the base fabric alone.

3. The multispectral cooling material of claim 1, wherein the multispectral cooling material reflects greater than 30% more of the solar energy in the 0.25 μm to 2.5 μm wavelength range compared to the base fabric alone.

4. The multispectral cooling material of claim 1, wherein the multispectral cooling material reflects greater than 200% more of the solar energy in the 0.25 μm to 0.78 μm wavelength range compared to the base fabric alone.

5. The multispectral cooling material of claim 1, wherein the multispectral cooling material has a greater than 2% increase in energy emission in a 5.0 μm to 40 μm wavelength range compared to the base fabric alone.

6. The multispectral cooling material of claim 1, wherein the multispectral cooling elements comprise a white pigmented foil.

7. The multispectral cooling material of claim 1, wherein the metal oxide comprises $TiO_2$, ZnO, or a combination thereof.

8. The multispectral cooling material of claim 1, wherein the surface coverage area of the multispectral cooling elements is from about 15% to about 90% of the externally facing surface of the base fabric in at least one 1 inch by 1 inch unit cell.

9. The multispectral cooling material of claim 1, wherein the surface coverage area of the multispectral cooling elements varies across different regions of the multispectral cooling material.

10. The multispectral cooling material of claim 1, wherein the individual multispectral cooling elements are from about 0.1 mm in diameter to about 5.0 mm in diameter.

11. An article of bodywear comprising a multispectral cooling material, the material comprising:

a base fabric having an externally facing surface and having a performance characteristic; and one or more multispectral cooling elements coupled to the externally facing surface of the base fabric, the one or more multispectral cooling elements comprising a discontinuous array of foil elements containing metal oxide particles and a polymeric binder, wherein the foil elements have a thickness from about 0.1 μm to about 20.0 μm, wherein the placement and spacing of the one or more multispectral cooling elements leaves a portion of the base fabric uncovered and enables the base fabric to retain at least partial performance of the performance characteristic, and wherein the multispectral cooling material reflects greater than 50% more of the solar energy in the 0.25 μm to 0.78 μm wavelength range compared to the base fabric alone, has a greater than 10% reduction in transmitted solar energy in the 0.25 μm to 2.5 μm wavelength range compared to the base fabric alone, and has a greater than 1% increase in energy emission in a 5.0 μm to 40 μm wavelength range compared to the base fabric alone.

12. The article of bodywear of claim 11, wherein the multispectral cooling material reflects greater than 5% more of the solar energy in the 0.25 μm to 2.5 μm wavelength range compared to the base fabric alone.

13. The article of bodywear of claim 11, wherein the multispectral cooling elements comprise a white pigmented foil.

14. The article of bodywear of claim 11, wherein the metal oxide comprises $TiO_2$, ZnO, or a combination thereof.

15. The article of bodywear of claim 11, wherein the surface coverage area of the multispectral cooling elements is from about 15% to about 90% of the externally facing surface of the base fabric in at least one 1 inch by 1 inch unit cell.

16. The article of bodywear of claim 11, wherein the surface coverage area of the multispectral cooling elements varies across different regions of the article of bodywear.

17. The article of bodywear of claim 11, wherein the individual multispectral cooling elements are from about 0.1 mm in diameter to about 5.0 mm in diameter.

18. The multispectral cooling material of claim 1, wherein the metal oxide particles comprise rutile titanium dioxide.

19. The multispectral cooling material of claim 1, wherein the multispectral cooling elements are spaced apart by about 0.5 mm to about 5.0 mm.

* * * * *